US010359228B2

(12) United States Patent
Brostow et al.

(10) Patent No.: US 10,359,228 B2
(45) Date of Patent: Jul. 23, 2019

(54) LIQUEFACTION METHOD AND SYSTEM

(71) Applicant: Air Products and Chemicals, Inc., Allentown, PA (US)

(72) Inventors: Adam Adrian Brostow, Emmaus, PA (US); Fei Chen, Whitehouse Station, NJ (US); Mark Julian Roberts, Kempton, PA (US); Christopher Michael Ott, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 422 days.

(21) Appl. No.: 15/160,209

(22) Filed: May 20, 2016

(65) Prior Publication Data

US 2017/0336136 A1 Nov. 23, 2017

(51) Int. Cl.
*F25J 1/00* (2006.01)
*F25J 1/02* (2006.01)

(52) U.S. Cl.
CPC ..... *F25J 1/0022* (2013.01); *F25J 1/0052* (2013.01); *F25J 1/0055* (2013.01); *F25J 1/0214* (2013.01); *F25J 1/0216* (2013.01); *F25J 1/0227* (2013.01); *F25J 1/0238* (2013.01); *F25J 1/0264* (2013.01); *F25J 1/0265* (2013.01); *F25J 1/0268* (2013.01); *F25J 1/0274* (2013.01); *F25J 1/0292* (2013.01); *F25J 2210/06* (2013.01); *F25J 2220/64* (2013.01); *F25J 2270/12* (2013.01); *F25J 2270/66* (2013.01); *F25J 2270/906* (2013.01)

(58) Field of Classification Search
CPC ..... F25J 1/0263; F25J 1/0264; F25J 1/0265; F25J 1/0022; F25J 1/0274; F25J 1/0216; F25J 1/0268; F25J 3/04218; F25J 2210/06; F25J 2215/60
See application file for complete search history.

(56) References Cited

U.S. PATENT DOCUMENTS

| | | | | |
|---|---|---|---|---|
| 3,780,535 | A | 12/1973 | Darredeau | |
| 6,370,910 | B1 | 4/2002 | Grootjans et al. | |
| 6,389,844 | B1 | 5/2002 | Klein Nagel Voort | |
| 8,464,551 | B2 | 6/2013 | Roberts et al. | |
| 8,656,733 | B2 | 2/2014 | Roberts et al. | |
| 9,273,899 | B2 | 3/2016 | Kevenaar et al. | |
| 2008/0156037 | A1 | 7/2008 | Van De Graaf | |
| 2009/0241593 | A1* | 10/2009 | Jager | F25J 1/0022 62/613 |
| 2009/0282862 | A1* | 11/2009 | Chantant | F25J 1/0022 62/614 |

(Continued)

FOREIGN PATENT DOCUMENTS

| | | | |
|---|---|---|---|
| DE | 3521060 | A1 | 12/1985 |
| EP | 1367350 | A1 | 12/2003 |

(Continued)

OTHER PUBLICATIONS

WO2008095713 Translation (Year: 2008).*

*Primary Examiner* — Brian M King
(74) *Attorney, Agent, or Firm* — Amy Carr-Trexler

(57) ABSTRACT

A system and method for liquefaction of a natural gas stream utilizing a plurality of asymmetric parallel pre-cooling circuits. The use of asymmetric parallel cooling circuits allows for greater control over each refrigerant stream during the cooling process and simplifies process control by dedicating heat exchangers to performing similar duties.

9 Claims, 10 Drawing Sheets

(56) References Cited

U.S. PATENT DOCUMENTS

| | | | | |
|---|---|---|---|---|
| 2009/0314030 | A1* | 12/2009 | Jager | F25J 1/0218 62/612 |
| 2010/0147024 | A1 | 6/2010 | Roberts et al. | |

FOREIGN PATENT DOCUMENTS

| | | | | |
|---|---|---|---|---|
| EP | 3001128 | A1 | 3/2016 | |
| WO | 2008095713 | A2 | 8/2008 | |
| WO | WO-2008095713 | A2 * | 8/2008 | F25J 1/0217 |

* cited by examiner

LIQUEFACTION METHOD AND SYSTEM

BACKGROUND OF THE INVENTION

The present invention relates to a method and system for liquefaction of a gas stream, more specifically, to a system and method for liquefaction of a natural gas stream in a natural gas liquefaction plant. Systems for cooling, liquefying, and optionally sub-cooling natural gas are well known in the art, such as the single mixed refrigerant (SMR) cycle, propane pre-cooled mixed refrigerant (C3MR) cycle, dual mixed refrigerant (DMR) cycle, C3MR-Nitrogen hybrid (such as the AP-X® process) cycles, nitrogen or methane expander cycle, and cascade cycles. Typically, in such systems, natural gas is cooled, liquefied, and optionally sub-cooled by indirect heat exchange with one or more refrigerants. A variety of refrigerants might be employed, such as mixed refrigerants, pure components, two-phase refrigerants, gas phase refrigerants, etc. Mixed refrigerants (MR), which are a mixture of nitrogen, methane, ethane/ethylene, propane, butanes, and optionally pentanes, have been used in many base-load liquefied natural gas (LNG) plants. The composition of the MR stream is typically selected based on the feed gas composition and operating conditions.

The refrigerant is circulated in a refrigerant circuit that includes one or more heat exchangers and one or more refrigerant compression systems. The refrigerant circuit may be closed-loop or open-loop. Natural gas is cooled, liquefied, and/or sub-cooled by indirect heat exchange against the refrigerants in the heat exchangers.

Each refrigerant compression system includes a compression circuit for compressing and cooling the circulating refrigerant, and a driver assembly to provide the power needed to drive the compressors. The refrigerant compression system is a critical component of the liquefaction system because the refrigerant needs to be compressed to high pressure and cooled prior to expansion in order to produce a cold low pressure refrigerant stream that provides the heat duty necessary to cool, liquefy, and optionally sub-cool the natural gas.

In designing and operating an LNG liquefaction plant the selection of heat exchangers, compressors and related equipment is a significant consideration affecting the cost of constructing and operating the plant. A typical prior art system consists of a two-step process whereby a natural gas feed is precooled in a pre-cooler heat exchanger to sub-ambient temperature and then condensed (liquefied) in a main cryogenic heat exchanger (MCHE).

During the pre-cooling step of a typical prior art system, the natural gas to be liquefied is pre-cooled in the hot side (or end) of a pre-cooling heat exchanger by heat exchange with refrigerant evaporating in the cold side. Evaporated refrigerant is removed from the cold side of the heat exchanger. This evaporated refrigerant is liquefied in the pre-cooling refrigerant circuit. To this end, the refrigerant is compressed in a compressor to an elevated pressure, and the heat of compression and the heat of vaporization are removed in a condenser. The liquid refrigerant is allowed to expand in the expansion device to a lower pressure, and at this pressure the refrigerant is allowed to evaporate in the cold side of the natural gas pre-cooling heat exchanger.

There have been efforts in the prior art directed towards the design of the pre-cooling system in order to achieve greater capacity, efficiency and to reduce cost. The use of multiple pre-coolers in series is one such approach. For example, it is known in the art to use two pre-cooler heat exchangers in series and two parallel MCHE's to increase the production rate of a single liquefaction train while reducing the capital expenditure below that of a system using two smaller parallel trains.

It is also known in the art that two pre-cooler heat exchangers in series, a scrub column and a single MCHE can achieve colder gas feed temperatures and improved liquefaction efficiency.

Another approach is the use of parallel cooling cycles. For example, at least one known system uses two identical pre-cooler heat exchangers in parallel with two parallel compression trains and a single MCHE. The two identical exchangers each handle 50% of the load and are intended to be identical (i.e., identical structure, identical stream inputs, identical refrigeration, and identical stream outputs) to simplify the design and manufacturing of the plant and to provide efficiency of maintenance costs. Each component of the system (compressors, heat exchangers, etc.) are selected from the largest available on the market to reduce the number of components required and to minimize capital and operating costs. The two parallel identical heat exchanger configuration provides the advantages of: (a) increasing capacity of the plant to the maximum possible production rate, achieved by maximizing the size of each exchanger within manufacturing and transportation limits; and (b) increasing the capacity of the plant to some intermediate production rate higher than production achieved by using a single exchanger.

In addition, capital investment savings, shortened manufacturing time ease of operation and maintenance are some of the well-known benefits of using duplicate equipment in parallel. However, providing identical parallel heat exchangers also presents several challenges. For example, each heat exchanger must cool multiple streams having different heat demands. The two exchangers must also be well-balanced during operation to assure equal duties and to avoid so-called manifold effect—i.e., different flows in pipes branching from the main pipe due to the varying distance from the main pipe inlet and, therefore, varying frictional pressure losses. This adds complexity to the operation of the system and introduces inefficiencies due to the compromises which must be made to keep the exchangers balanced.

Another disadvantage of using multiple identical heat exchangers is the need for an increased number of cooling circuits. For example, assuming two parallel identical heat exchangers are used to cool each of three different streams: the gas feed stream; the warm mixed refrigerant (WMR); and cold mixed refrigerant (CMR), six cooling circuits will be required. This adds complexity to the system and makes the addition of a second identical heat exchanger in parallel impractical for many existing systems.

Accordingly, there is a need to develop a process for natural gas liquefaction that allows for combining multiple exchanger designs while shortening the manufacturing time, simplifying process control, minimizing the number of refrigeration circuits, improving efficiency and increasing LNG production. Such arrangement should preferably be suitable for use as a retrofit or for a new design.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments provide, as described below and as defined by the claims which follow, refrigerant pre-cooling systems used as part of a liquefaction processes. The disclosed embodiments satisfy the need in the art by using asymmetrical parallel heat exchangers to isolate refrigerant streams into dedicated heat exchangers, allowing for greater control and efficiency of the pre-cooling process. Embodiments of the present invention satisfy the need in the art by providing a safe, efficient, and reliable system and process for liquefaction, and specifically for natural gas liquefaction. Additional aspects of the invention are as follows.

Aspect 1: A method for liquefying a hydrocarbon feed stream, the method comprising:

(a) providing a hydrocarbon fluid feed stream at a first feed temperature;

(b) splitting the hydrocarbon fluid feed stream into a first portion and a second portion;

(c) cooling the first portion of the hydrocarbon fluid feed stream in a first pre-cooling heat exchanger against a first mixed refrigerant to form a first pre-cooled hydrocarbon fluid stream that exits the first pre-cooling heat exchanger at a first pre-cooled temperature;

(d) cooling the second portion of the hydrocarbon fluid feed stream in a second pre-cooling heat exchanger against the first mixed refrigerant to form a second pre-cooled hydrocarbon fluid stream that exits the second pre-cooling heat exchanger at a second pre-cooled temperature;

(e) withdrawing an evaporated second mixed refrigerant stream from a shell side of a main heat exchanger;

(f) compressing and expanding the evaporated second mixed refrigerant stream to form a resultant second mixed refrigerant stream at a resultant second mixed refrigerant temperature, the resultant second mixed refrigerant temperature being substantially equal to the first feed temperature;

(g) cooling the resultant second mixed refrigerant stream in the second pre-cooling heat exchanger against the first mixed refrigerant to form a pre-cooled second mixed refrigerant stream that exits the second pre-cooling heat exchanger at a third pre-cooled temperature;

(h) combining the first pre-cooled hydrocarbon fluid stream and the second pre-cooled hydrocarbon fluid stream and introducing the combined pre-cooled hydrocarbon fluid stream into the tube side of the main heat exchanger;

(i) introducing at least a portion of the pre-cooled second mixed refrigerant stream into the tube side of the main heat exchanger;

(j) cooling the combined pre-cooled hydrocarbon fluid stream in the main heat exchanger against the second mixed refrigerant on the shell side of the main heat exchanger to form a liquefied hydrocarbon fluid stream;

(k) cooling the at least a portion of the pre-cooled second mixed refrigerant stream in the main heat exchanger against a flow the second mixed refrigerant on the shell side of the main heat exchanger to form at least one cooled second mixed refrigerant stream; and (l) withdrawing each of the at least one cooled second mixed refrigerant stream from the tube side of the main heat exchanger, expanding each of the each of the at least one cooled second mixed refrigerant stream to form an expanded second refrigerant stream, and providing each of the at least one expanded second mixed refrigerant stream to the shell side of the main heat exchanger.

Aspect 2: The method of Aspect 1, further comprising:

(m) separating a liquid portion of the pre-cooled second mixed refrigerant stream from a vapor portion of the pre-cooled second refrigerant mixed stream;

wherein step (i) comprises introducing the liquid portion of pre-cooled second mixed refrigerant stream and the vapor portion of the pre-cooled second mixed refrigerant stream into the tube side of the main heat exchanger.

Aspect 3: The method of any one of Aspects 1 through 2, wherein the second pre-cooled temperature and third pre-cooled temperature are substantially equal to the first pre-cooled temperature.

Aspect 4: The method of any one of Aspects 1 through 3, wherein step (f) comprises compressing and cooling the second mixed refrigerant stream to form a resultant second mixed refrigerant stream at a resultant second mixed refrigerant temperature, the resultant second mixed refrigerant temperature being substantially equal to the first feed temperature and substantially all of the resultant second mixed refrigerant stream is vapor phase.

Aspect 5: The method of any one of Aspects 1 through 4, wherein step (c) comprises cooling the first portion of the hydrocarbon fluid feed stream in a tube side of a first pre-cooling heat exchanger against a first mixed refrigerant flowing through a shell side of the first pre-cooling heat exchanger to form a first pre-cooled hydrocarbon fluid stream that exits the first pre-cooling heat exchanger at a first pre-cooled temperature.

Aspect 6: The method of Aspect 5, wherein step (d) comprises cooling the second portion of the hydrocarbon fluid feed stream in a tube side of a second pre-cooling heat exchanger against the first mixed refrigerant flowing through a shell side of the second pre-cooling heat exchanger to form a second pre-cooled hydrocarbon fluid stream that exits the second pre-cooling heat exchanger at a second pre-cooled temperature.

Aspect 7: The method of any one of Aspects 1 through 6, wherein the second step (d) comprises cooling the second portion of the hydrocarbon fluid feed stream a second pre-cooling heat exchanger against the first mixed refrigerant to form a second pre-cooled hydrocarbon fluid stream that exits the second pre-cooling heat exchanger at a second pre-cooled temperature, the second pre-cooling heat exchanger having a different geometry from the first pre-cooling heat exchanger.

Aspect 8: The method of any one of Aspects 1 through 7, further comprising:

(n) circulating the first mixed refrigerant in a closed refrigeration loop that flows through a shell side of each of the first and second pre-cooling heat exchangers.

Aspect 9: The method of any one of Aspects 1 through 8, further comprising:

(o) withdrawing an evaporated first mixed refrigerant stream from a shell side of each of the first and second pre-cooling heat exchangers;

(p) compressing and cooling the evaporated first mixed refrigerant stream to form a resultant first mixed refrigerant stream;

(q) introducing the resultant first mixed refrigerant stream into a tube side of the first pre-cooling heat exchanger;

(r) cooling the resultant first mixed refrigerant stream in the first pre-cooling heat exchanger against a flow of the first mixed refrigerant on the shell side of the first pre-cooling heat exchanger to form a cooled first mixed refrigerant stream;

(s) withdrawing the cooled first mixed refrigerant stream from the first pre-cooling heat exchanger and splitting the cooled first mixed refrigerant stream into first and second cooled first mixed refrigerant streams;

(t) expanding each of the first and second cooled first mixed refrigerant streams to form first and second expanded first mixed refrigerant streams; and (u) introducing the first expanded first mixed refrigerant stream into the shell side of the first pre-cooling heat exchanger; and (v) introducing the second expanded first mixed refrigerant stream into a shell side of the second pre-cooling heat exchanger.

Aspect 10: The method of any one of Aspects 1 through 9, wherein step (d) comprises:

(d) cooling the second portion of the hydrocarbon fluid feed stream in a second pre-cooling heat exchanger against the first mixed refrigerant to form a second pre-cooled hydrocarbon fluid stream that exits the second pre-cooling heat exchanger at a second pre-cooled temperature, the second pre-cooling heat exchanger having the same refrigeration duty as the first pre-cooling heat exchanger.

Aspect 11: A method for liquefying a hydrocarbon feed stream in main heat exchanger, the main heat exchanger being a coil wound heat exchanger having a tube side, a shell side, a cold end, and n warm end, the method comprising:

(a) providing a hydrocarbon fluid feed stream at a first feed temperature;

(b) cooling the hydrocarbon fluid feed stream in a first pre-cooling heat exchanger to form a first pre-cooled hydrocarbon fluid stream that exits the first pre-cooling heat exchanger at a first pre-cooled temperature;

(c) withdrawing a first evaporated low-pressure mixed refrigerant stream from the shell side of the main heat exchanger;

(d) compressing and cooling the evaporated low-pressure mixed refrigerant stream to form a resultant refrigerant stream at a first resultant refrigerant temperature;

(e) separating the resultant refrigerant stream into a first resultant mixed refrigerant stream that is vaporous and a second resultant mixed refrigerant stream that is liquid;

(f) introducing the first resultant mixed refrigerant stream into the tube side of the main heat exchanger;

(g) cooling the first resultant mixed refrigerant stream in the tube side of the main heat exchanger;

(h) withdrawing and expanding the cooled first resultant mixed refrigerant stream from the tube side of the main heat exchanger at a second location to create an expanded first resultant mixed refrigerant stream;

(i) introducing the expanded first resultant mixed refrigerant stream to the shell side of the main heat exchanger at a first location;

(j) introducing the second resultant mixed refrigerant stream into a tube side of an auxiliary heat exchanger;

(k) cooling the second resultant mixed refrigerant stream against a second expanded mixed refrigerant stream flowing through a shell side of the auxiliary heat exchanger to form a cooled second resultant mixed refrigerant stream;

(l) withdrawing the cooled second resultant mixed refrigerant stream from the tube side of the auxiliary heat exchanger;

(m) expanding and introducing at least a first portion of the cooled second resultant mixed refrigerant stream into the shell side of the main heat exchanger at a second location, the second location being closer to the warm end of the main heat exchanger than the first location.

Aspect 12: The method of Aspect 11, further comprising:

(o) withdrawing a second evaporated low-pressure mixed refrigerant stream from a shell side of the auxiliary heat exchanger;

(p) combining the second evaporated low-pressure mixed refrigerant stream with the first evaporated low-pressure mixed refrigerant stream before performing step (d).

Aspect 13: The method of any one of Aspects 11 through 12, wherein step (k) comprises:

(k) cooling the second resultant mixed refrigerant stream against a second expanded mixed refrigerant stream flowing through a shell side of the auxiliary heat exchanger to form a cooled second resultant mixed refrigerant stream, the second expanded mixed refrigerant stream being selected from the group consisting of: a portion of the second resultant mixed refrigerant, a second mixed refrigerant that is part of a closed refrigeration loop.

Aspect 14: The method of any one of Aspects 11 through 13, wherein step (k) comprises:

(l) cooling the second resultant mixed refrigerant stream against a second expanded mixed refrigerant stream flowing through a shell side of the auxiliary heat exchanger to form a cooled second resultant mixed refrigerant stream, the second expanded mixed refrigerant stream being a second mixed refrigerant that is part of a closed refrigeration loop.

Aspect 15: An apparatus for liquefaction of a hydrocarbon fluid, the apparatus comprising:

a precooling subsystem fluidly connected to a hydrocarbon fluid feed stream and operationally configured to cool the hydrocarbon fluid feed stream to below ambient temperature by indirect heat exchange against a first refrigerant to create precooled hydrocarbon fluid stream and to cool a second refrigerant stream against the first refrigerant to create a precooled second refrigerant stream, the first and second refrigerants each comprising a mixed refrigerant, the precooling subsystem comprising a first precooling heat exchanger and a second first precooling heat exchanger, the first precooling heat exchanger being operationally configured to cool a first set of fluid streams, comprising at least one fluid stream, by indirect heat exchange against the first refrigerant, the second precooling heat exchanger being operationally configured to cool a second set of fluid streams, comprising at least one fluid stream, by indirect heat exchange against the first refrigerant, at least one of the first and second fluid streams comprising the hydrocarbon fluid and at least one of the first and second fluid streams comprising the second refrigerant; and a main heat exchanger fluidly coupled to the precooling subsystem and operationally configured to receive the precooled hydrocarbon fluid stream and precooled second refrigerant stream and to cool the precooled hydrocarbon fluid stream by indirect heat exchange against the second refrigerant to create a hydrocarbon fluid product stream that is at least partially liquefied;

wherein the first and second refrigerants are both mixed refrigerants;

wherein one of the first and second sets of fluid streams has at least one fluid stream having a composition that is not found in any fluid stream of the other of the first and second set of fluid streams; and wherein each of the first set of fluid streams enters and exits that the first pre-cooling heat exchanger at substantially the same temperature as each of the second set of fluid streams enters and exits the second pre-cooling heat exchanger.

Aspect 16: The apparatus of Aspect 15, wherein refrigeration duty for the first and second pre-cooling heat exchangers is provided solely by the first refrigerant and refrigeration duty for the main heat exchanger is provided solely by the second refrigerant.

BRIEF DESCRIPTION OF THE DRAWING(S)

The foregoing brief summary, as well as the following detailed description of exemplary embodiments, is better understood when read in conjunction with the appended drawings. For the purpose of illustrating embodiments of the invention, there is shown in the drawings exemplary constructions of the invention; however, the invention is not limited to the specific methods and instrumentalities disclosed. In the drawings.

DETAILED DESCRIPTION OF THE PREFERRED EMBODIMENT(S)

Figure 1:
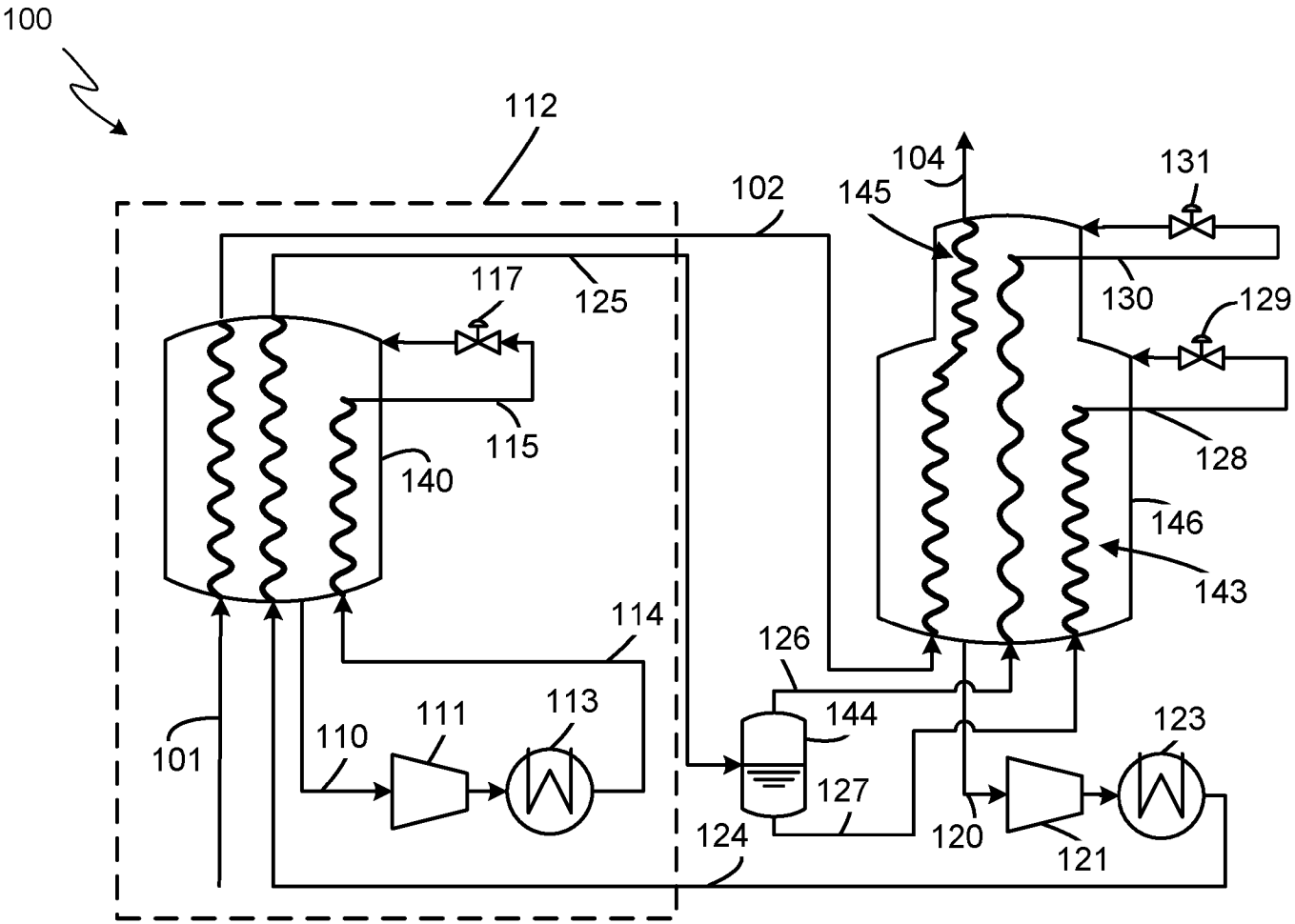
FIG. 1 (PRIOR ART)
FIG. 1 is a schematic flow diagram of a gas liquefaction method and system in accordance with the prior art.

The ensuing detailed description provides preferred exemplary embodiments only, and is not intended to limit the scope, applicability, or configuration of the claimed invention. Rather, the ensuing detailed description of the preferred exemplary embodiments will provide those skilled in the art with an enabling description for implementing the preferred exemplary embodiments of the claimed invention. Various changes may be made in the function and arrangement of elements without departing from the spirit and scope of the claimed invention.

Reference numerals that are introduced in the specification in association with a drawing figure may be repeated in one or more subsequent figures without additional description in the specification in order to provide context for other features.

In the claims, letters are used to identify claimed steps (e.g. (a), (b), and (c)). These letters are used to aid in referring to the method steps and are not intended to indicate the order in which claimed steps are performed, unless and only to the extent that such order is specifically recited in the claims.

Directional terms may be used in the specification and claims to describe portions of the present invention (e.g., upper, lower, left, right, etc.). These directional terms are merely intended to assist in describing exemplary embodiments, and are not intended to limit the scope of the claimed invention. As used herein, the term "upstream" is intended to mean in a direction that is opposite the direction of flow of a fluid in a conduit from a point of reference. Similarly, the term "downstream" is intended to mean in a direction that is the same as the direction of flow of a fluid in a conduit from a point of reference.

Unless otherwise stated herein, any and all percentages identified in the specification, drawings and claims should be understood to be on a weight percentage basis. Unless otherwise stated herein, any and all pressures identified in the specification, drawings and claims should be understood to mean gauge pressure.

The terms "fluid flow communication," "fluidly connected", and "fluidly coupled", as used in the specification and claims, refers to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The terms "hydrocarbon gas" or "hydrocarbon fluid", as used in the specification and claims, means a gas/fluid comprising at least one hydrocarbon and for which hydrocarbons comprise at least 80%, and more preferably at least 90% of the overall composition of the gas/fluid.

The term "natural gas", as used in the specification and claims, means a hydrocarbon gas mixture consisting primarily of methane.

The term "mixed refrigerant" (abbreviated as "MR"), as used in the specification and claims, means a fluid comprising at least two hydrocarbons and for which hydrocarbons comprise at least 80% of the overall composition of the refrigerant.

When used in the context of comparing multiple temperatures, the term "substantially equal", as used in the specification and claims, is intended to mean a temperature difference of no more than 20 degrees C. and, more preferably, no more than 10 degrees C.

When used in the context of a fluid phase, the term "substantially", as used in the specification and claims, is intended to mean that the fluid being described is composed of at least 90% of that phase and, more preferably, at least 95% of that phase. For example, a "substantially vapor" fluid would be composed of at least 90% vapor (more preferably at least 95%).

FIG. 1 shows an exemplary natural gas liquefaction system 100 of the prior art. In this system 100, a natural gas feed 101 is cooled in a pre-cooling subsystem 112 to below-ambient temperature using a single pre-cooler heat exchanger 140. A resulting stream 102 is further cooled and completely condensed (liquefied) in a coil-wound main cryogenic heat exchanger (MCHE) 146, to produce a liquefied natural gas (LNG) product 104. A pre-cooling mixed refrigerant stream 110 (often referred to as warm MR or WMR) is compressed in a compressor 111 and cooled and preferably liquefied in pre-cooler heat exchanger 113. The pre-cooler heat exchanger 113 can be broken down into multiple exchangers such as desuperheater, aftercooler, and/or condenser. The resulting stream 114, substantially liquid at about-ambient temperature, is further cooled in the pre-cooler heat exchanger 140. The resulting stream 115, at below-ambient temperature, is throttled though valve 117 and introduced to the shell side of the pre-cooler heat exchanger 140. The evaporating WMR provides refrigeration in the pre-cooler heat exchanger 140, becoming a fully evaporated WMR stream 110, which closes the warm refrigeration cycle loop.

Another mixed refrigerant stream 120 (often referred to as cold MR or CMR) is compressed in compressor 121 and cooled in a heat exchanger 123. The heat exchanger 123 can be broken down into multiple exchangers such as desuperheater and/or aftercooler. The resulting stream 124, which is substantially vapor and at about-ambient temperature, is further cooled and partially liquefied in the pre-cooler heat exchanger 140. The resulting two-phase stream 125 (at below-ambient temperature) is separated in a phase separator 144 into a CMR vapor stream 126 (CMRV) and a CMR liquid stream 127 (CMRL). The CMRL stream 127, is cooled in the MCHE 146, then the resulting stream 128 at an intermediate cold temperature, is throttled in valve 129 and introduced into the shell side of the MCHE 146 at an intermediate point, typically above a warm bundle 143. The CMRV stream 126 is cooled and condensed in the MCHE. The CMRV stream 130, now fully liquefied, is throttled through valve 131 and introduced into the shell side of the MCHE 146 at the cold end, above a cold bundle 145. The evaporating CMR provides refrigeration in the MCHE 146. Fully evaporated CMR becomes stream 120, closing the cold refrigeration cycle loop.

As is known in the art, the pre-cooler heat exchanger 140 can be multiple identical parallel units, for example two or three units (not shown). Likewise, compressor 111 and cooler 113 can be multiple identical parallel units.

Figure 2:
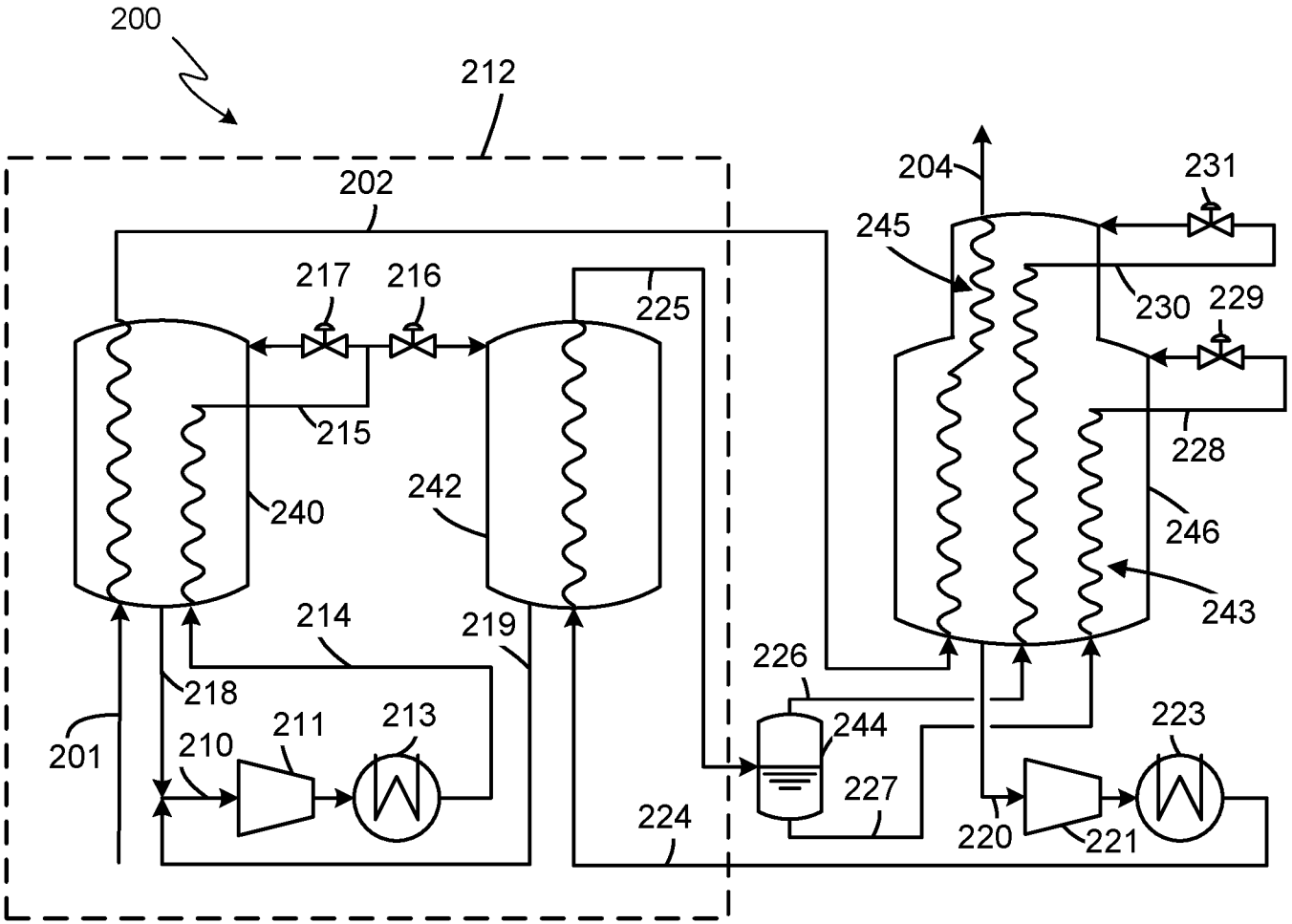
FIG. 2 is a schematic flow diagram of a gas liquefaction method and system in accordance with a first exemplary embodiment of the invention.

Embodiments of the present invention provide a novel improvement over the prior art by using a plurality of asymmetric pre-coolers. FIG. 2 shows one exemplary embodiment of the present invention in which the pre-cooling subsystem 212 includes two parallel pre-cooler heat exchangers. A natural gas feed 201 is cooled in a first pre-cooler heat exchanger 240 to below-ambient temperature. Resulting stream 202 is further cooled and completely condensed (liquefied) in the MCHE 246, preferably of coil wound type, to produce LNG product 204. The pre-cooling mixed refrigerant stream 210, the WMR, is compressed in compressor 211 and cooled and preferably completely condensed in cooler heat exchanger 213. The cooler heat exchanger 213 can be broken down into multiple exchangers such as desuperheater, aftercooler, and/or condenser. The resulting stream 214, substantially liquid at about-ambient temperature, is further cooled in the first pre-cooler heat exchanger 240, producing a stream 215, which is at below ambient temperatures. This stream 215 is distributed between the shell sides of the first pre-cooler heat exchanger 240 and a second pre-cooler heat exchanger 242, after being throttled though valves 217 and 216, respectively. The distribution of this stream 215 is typically predetermined based on the operating conditions of the particular system 200. The evaporating WMR provides refrigeration in the two above-mentioned pre-cooler heat exchangers 240, 242. Therefore, WMR provides refrigeration for the high-pressure liquid WMR stream 214 (auto-refrigeration). Fully evaporated WMR streams 218 and 219 are combined to form above-mentioned stream 210, closing the warm refrigeration cycle loop.

Another mixed refrigerant stream 220, the cold MR or CMR, is compressed in a compressor 221 and cooled in a heat exchanger 223. The heat exchanger 223 can be broken down into multiple exchangers such as desuperheater and/or aftercooler. The resulting stream 224, substantially vapor at about-ambient temperature, is further cooled in the second pre-cooler heat exchanger 242. The resulting two-phase stream 225, at below-ambient temperature, is separated in phase separator 244 into a CMR vapor stream 226 (CMRV) and a CMR liquid stream 227 (CMRL). The CMRL stream 227, is cooled in the MCHE 246. The resulting CMR stream 228, at intermediate cold temperature, is throttled in a valve 229 and introduced into the shell side of the MCHE 246 at an intermediate point, typically above the warm bundle 243. The CMRV stream 226, is cooled and condensed in the MCHE 246. The resulting CMRV stream 230 (now fully liquefied) is introduced into the shell side of the MCHE 246 at the cold end, above the cold bundle 245. The evaporating CMR provides refrigeration in the MCHE 246. Fully evaporated CMR becomes stream 220, closing the cold refrigeration cycle loop.

Applicants have discovered that it is advantageous to cool the natural gas feed 201 and WMR 214 in the same heat exchanger because the natural gas feed 201 is typically at supercritical pressure and does not undergo a sharp phase transition in the first pre-cooler heat exchanger 240. The WMR 214 is fully condensed (liquid) and likewise does not undergo a phase change. In contrast, gaseous CMR 224 is partially condensed as it passes through the second pre-cooler heat exchanger 242. The first and second pre-cooler heat exchangers preferably have different geometry to accommodate different type of duties (sensible vs. latent) and different cooling curves. However, it would be apparent to those skilled in the art that CMR 224 could be cooled in the first pre-cooler heat exchanger and WMR 214 could be cooled in the second pre-cooler heat exchanger.

As used herein in the context of comparing multiple heat exchangers, the term "different geometry" means that the heat exchangers being compared are different in at least one of the following respects: length, diameter, mandrel outer diameter, spacer thickness, number of spacers, tubing inner diameter, tubing outer diameter, tube length, tube pitch, tube winding angle, and design pressure (pressure rating).

Since the two pre-cooler heat exchangers 240, 242 may have different duties, they can be controlled independently, without the need to balance. Control variables may include, but are not limited to, cold-end temperatures, and warm-end shell-side temperatures.

Figure 3:
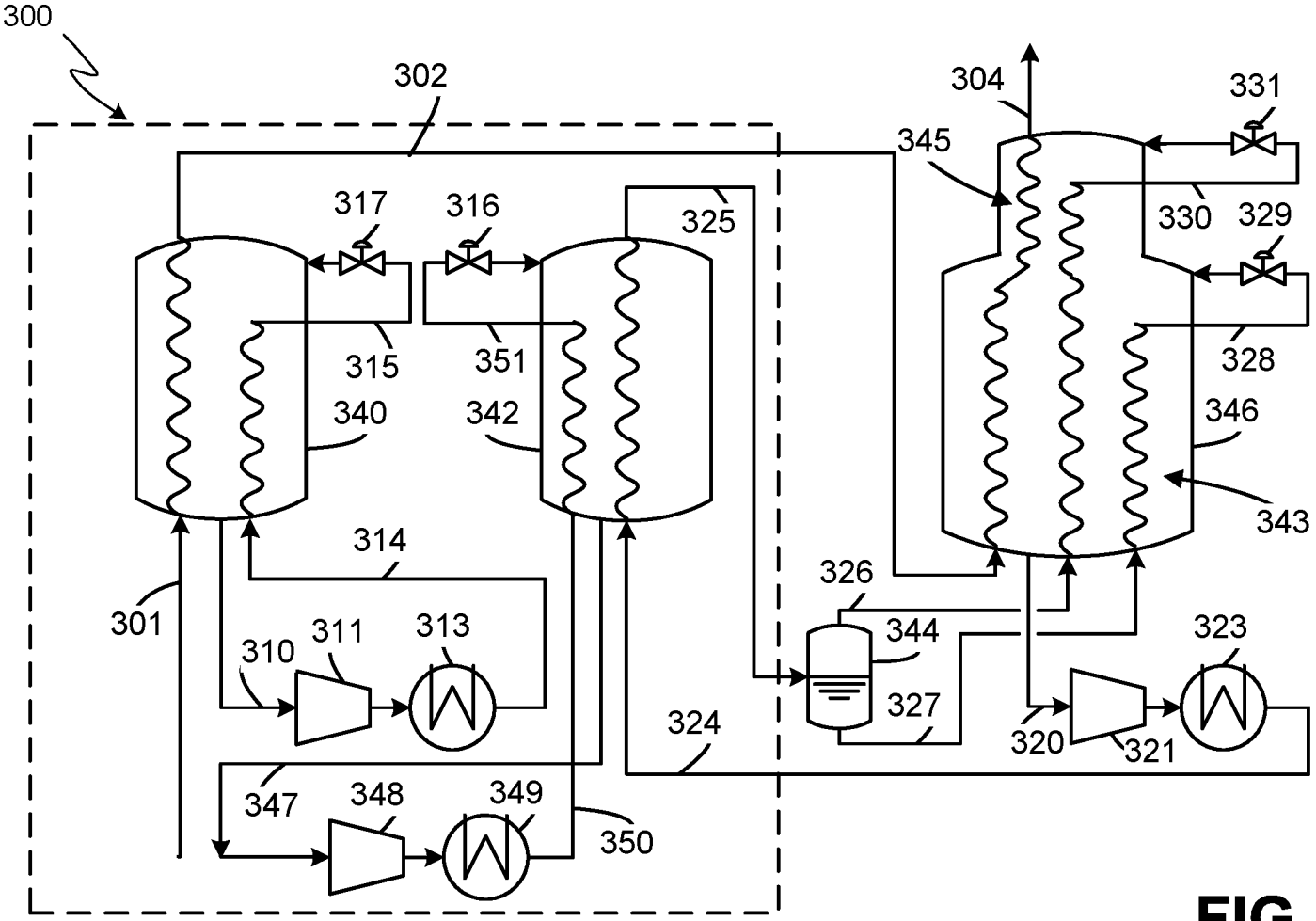
FIG. 3 is a schematic flow diagram of a gas liquefaction method and system in accordance with a second exemplary embodiment of the invention.

FIG. 3 shows another exemplary embodiment of the present invention 300. In this embodiment, elements shared with the second embodiment (System 200) are represented by reference numerals increased by factors of 100. For example, the MCHE 246 in FIG. 2 corresponds to the MCHE 346 in FIG. 3. In the interest of clarity, some features of this embodiment that are shared with the second embodiment are numbered in FIG. 3, but are not repeated in the specification. If a reference numeral is provided in this embodiment and not discussed in the specification, it should be understood to be identical to the corresponding element of the second embodiment. These same principles apply to each of the subsequent exemplary embodiments.

In this embodiment, a separate refrigeration loop is provided for the second pre-cooler heat exchanger 342. A second pre-cooling mixed refrigerant stream 347 (second WMR) is compressed in compressor 348 and cooled and preferably completely liquefied in cooler heat exchanger 349. The resulting stream 350, substantially liquid at about-ambient temperature, is further cooled in the second pre-cooler heat exchanger 342. Stream 351, at below-ambient temperature, is introduced to the shell side of the second pre-cooler heat exchanger 342 after being throttled through a valve 316. The evaporating second WMR provides refrigeration in the second pre-cooler heat exchanger. Therefore, the second WMR 342 provides refrigeration for the second high-pressure liquid WMR stream 350 (auto-refrigeration). This configuration adds another degree of freedom: the ability to choose different WMR compositions for the two precooling MR streams 310 and 347 to better match different cooling curves.

It will be apparent to those skilled in the art that any liquid valves can be replaced with hydraulic turbines (isentropic dense fluid expanders).

Figure 4:
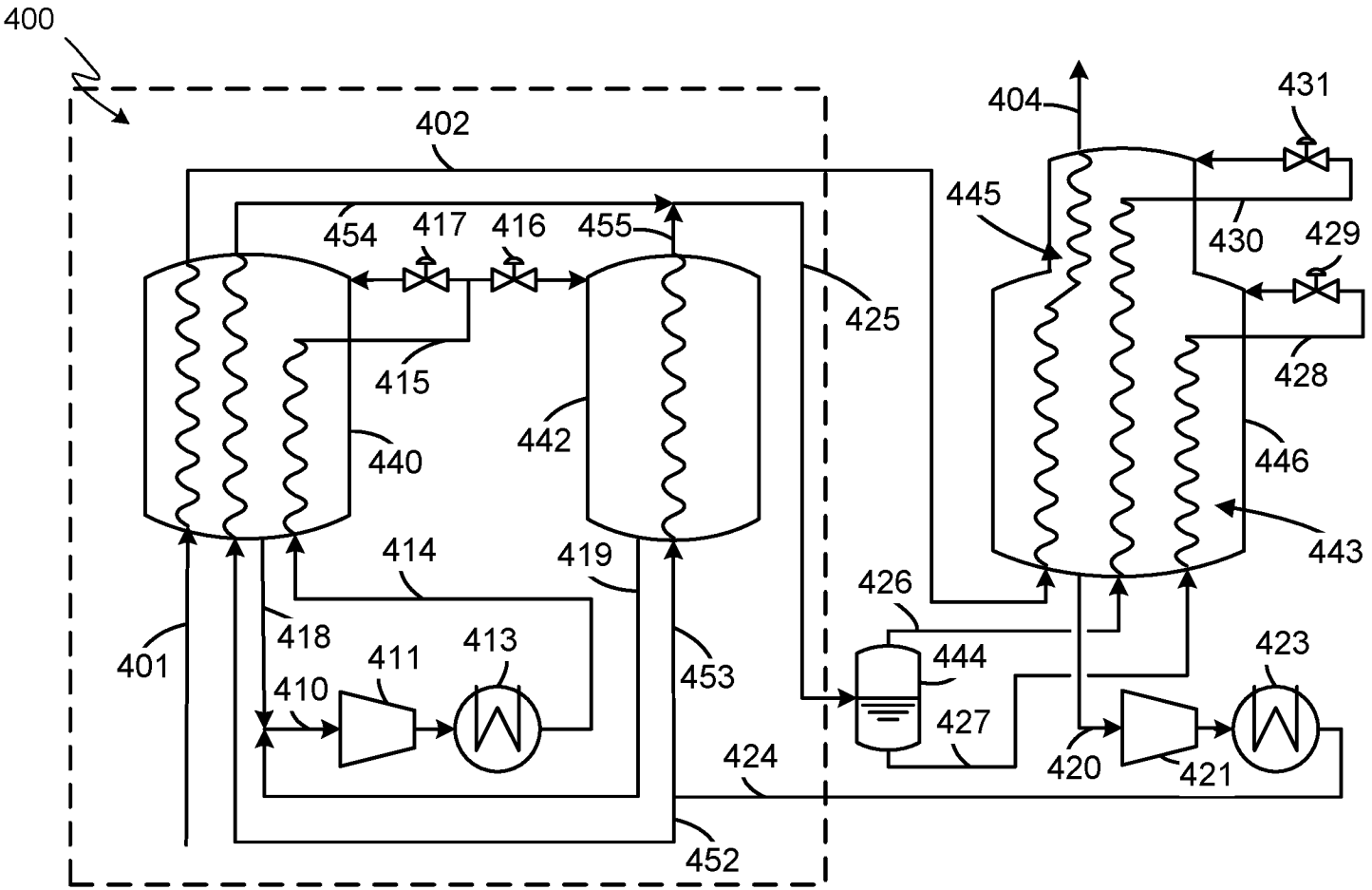
FIG. 4 is a schematic flow diagram of a gas liquefaction method and system in accordance with a third exemplary embodiment of the invention.

FIG. 4 shows another exemplary embodiment of a system 400. In this system 400, all three cooled streams 401, 452, 414 flow through the first pre-cooler heat exchanger 440. The second pre-cooler heat exchanger cools a portion of the CMR 453. This embodiment is particularly suitable for a retrofit application.

The high-pressure CMR stream 424 is distributed between the first and the second pre-cooler heat exchangers 440 and 442 as separate streams 452 and 453, respectively. The resulting cooled streams 454 and 455 are recombined into a single stream 425.

This configuration allows for an increase in the available heat exchange area (UA) and a reduced pressure drop. This embodiment may or may not require modifications to the CMR compressor 421 (different wheels, multiple parallel units, etc.), and aftercooler 423 due to an increase on MR flow.

Figure 5:
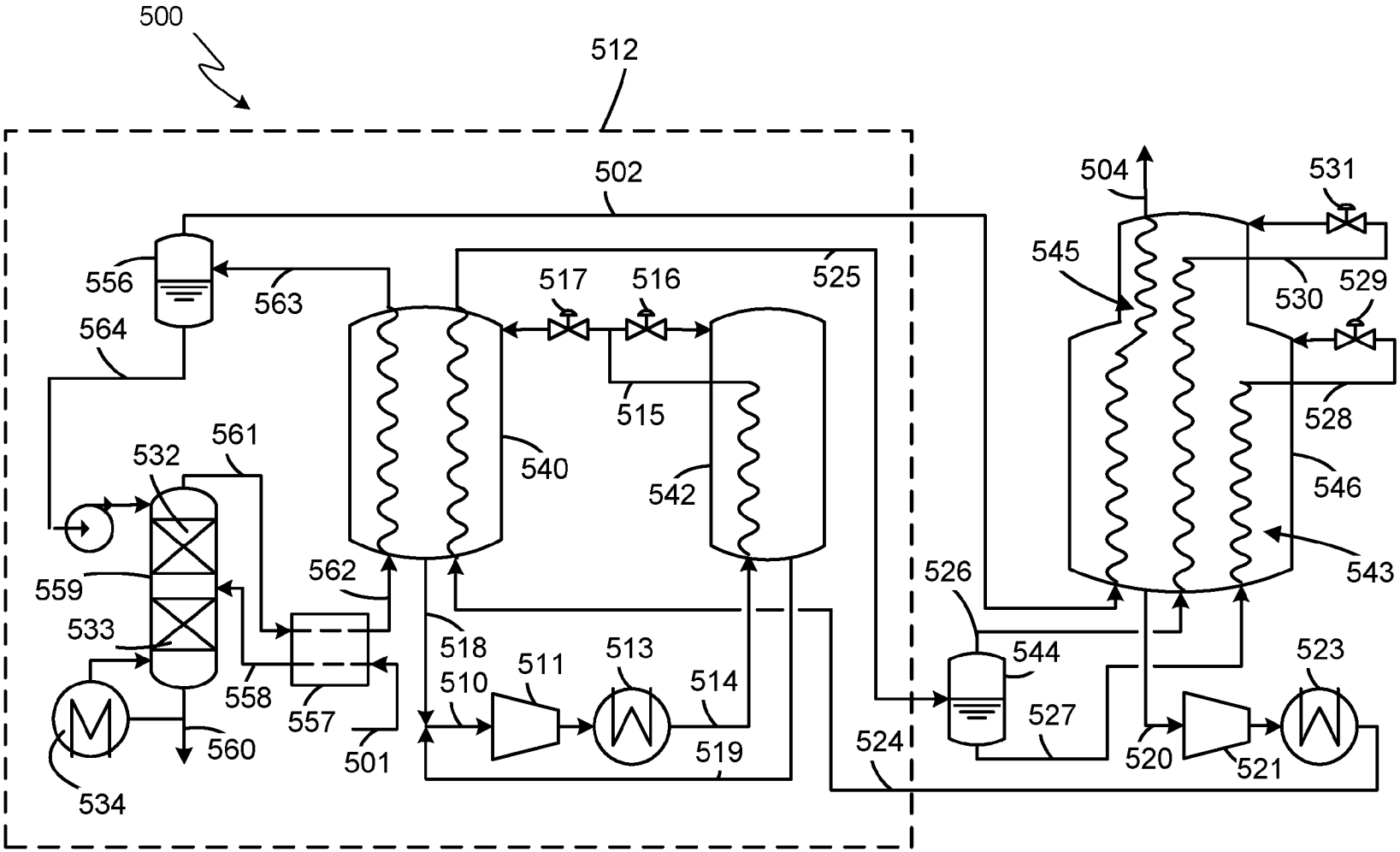
FIG. 5 is a schematic flow diagram of a gas liquefaction method and system in accordance with a fourth exemplary embodiment of the invention.

FIG. 5 shows another embodiment of a system 500, having a pre-cooling subsystem 512 that includes a scrub column 559 to remove heavy components that can be recovered as light petroleum gas (LPG) and/or natural gas liquid (NGL). A natural gas feed 501 is optionally cooled in a feed economizer heat exchanger 557 with the stream 558 being introduced to the scrub column 559. The scrub column 559 comprises a stripping section 533 and may comprise a rectifying section 532 and a reboiler 534. The resulting bottom stream 560, containing LPG and/or NGL components, is recovered from the bottom of the column. The overhead stream 561 is optionally reheated in the economizer heat exchanger 557 and the resulting stream 562 is introduced to the first pre-cooler heat exchanger 540. The resulting two-phase stream 563, at below-ambient temperature, is separated in phase separator 556 into a reflux stream 564 and heavy component-depleted NG stream 502. The heavy component-depleted NG stream 502 is liquefied in the MCHE 546 while the reflux stream 564 is introduced to the top of the scrub column by means of pumping or liquid head that overcomes the pressure drop in the first pre-cooler heat exchanger 540.

In the case of a scrub column 559, the natural gas feed stream 501 must be subcritical and undergoes a phase change (condensation). Therefore, it makes sense to co-locate the two condensing services (the natural gas feed 501 and CMR 524) in one heat exchanger 540, with the sensible duty (WMR 514) performed in another heat exchanger 542.

It will be apparent to those skilled in the art that the optionally reheated overhead stream 562 could also be cooled in the second heat exchanger 542 (two latent duties of condensation in one heat exchanger). The second heat exchanger 542 could alternatively be cooled by a separate loop, as shown in the system 300 of FIG. 3.

Figure 6:
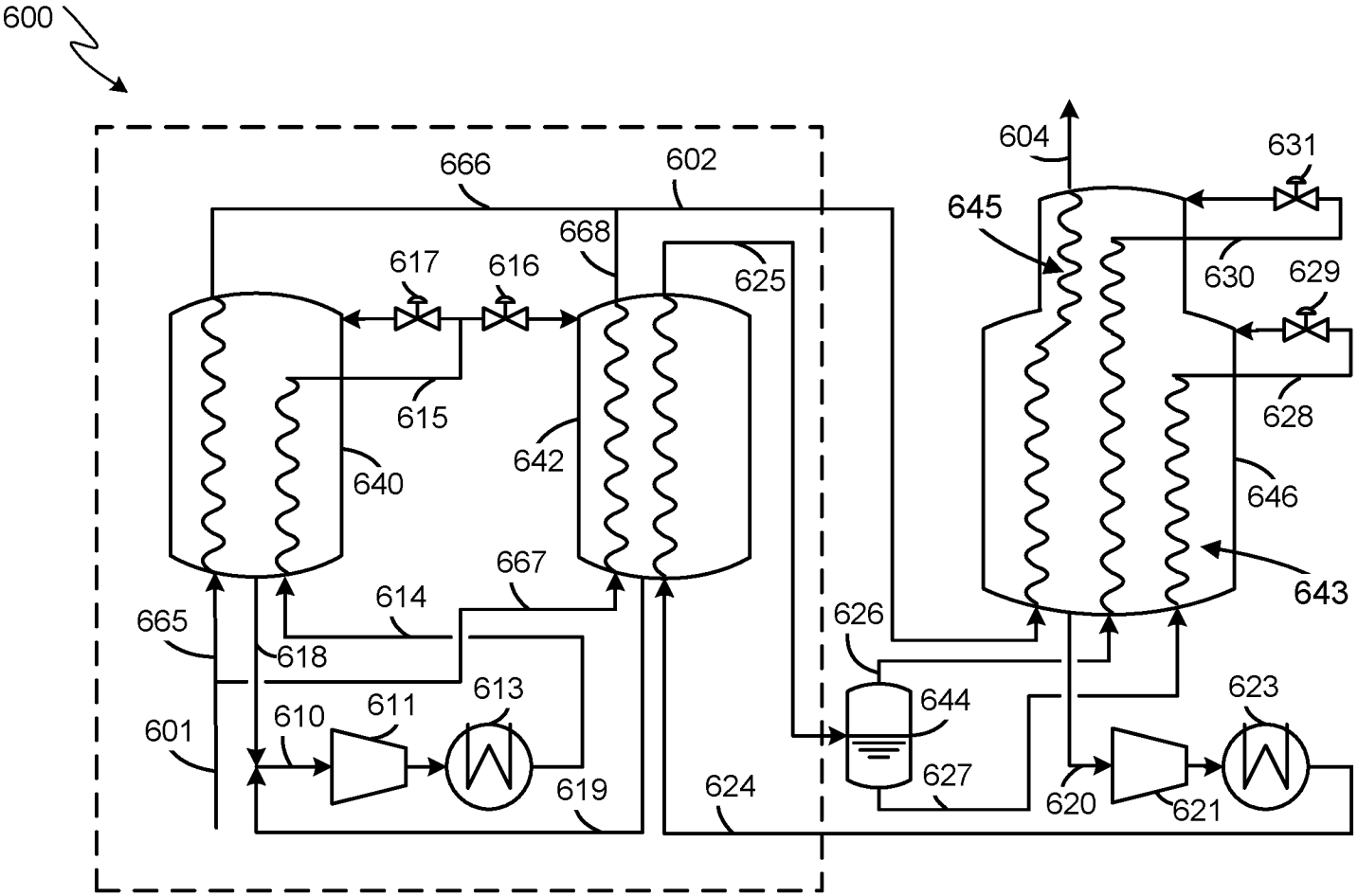
FIG. 6 is a schematic flow diagram of a gas liquefaction method and system in accordance with a fifth exemplary embodiment of the invention.

FIG. 6 shows a configuration 600 where the natural gas feed stream 601 is split in order to balance two pre-cooling heat exchangers 640 and 642 having similar duties. Feed stream 601 is split into two streams 665 and 667 which, in this embodiment, may have similar flows (47% and 53% of the flow of stream 601, respectively, in one example). The first feed stream 665 is cooled in the first pre-cooler heat exchanger 640 to produce a first cooled feed stream 666. The second feed stream 667 is cooled in the second pre-cooler heat exchanger 642 to produce a second cooled feed stream 668. The first and second cooled feed streams 666 and 668 are then combined into one stream 602, which is introduced into the MCHE 646. In this embodiment, the first pre-cooler 640 is all sensible duty (i.e., no phase change). This embodiment is well-suited to achieve maximum production from a plant—and will produce greater production than would be achieved by having pre-cooling heat exchanger having identical input and output streams and can operate more efficiently at the same production level.

Figure 7:
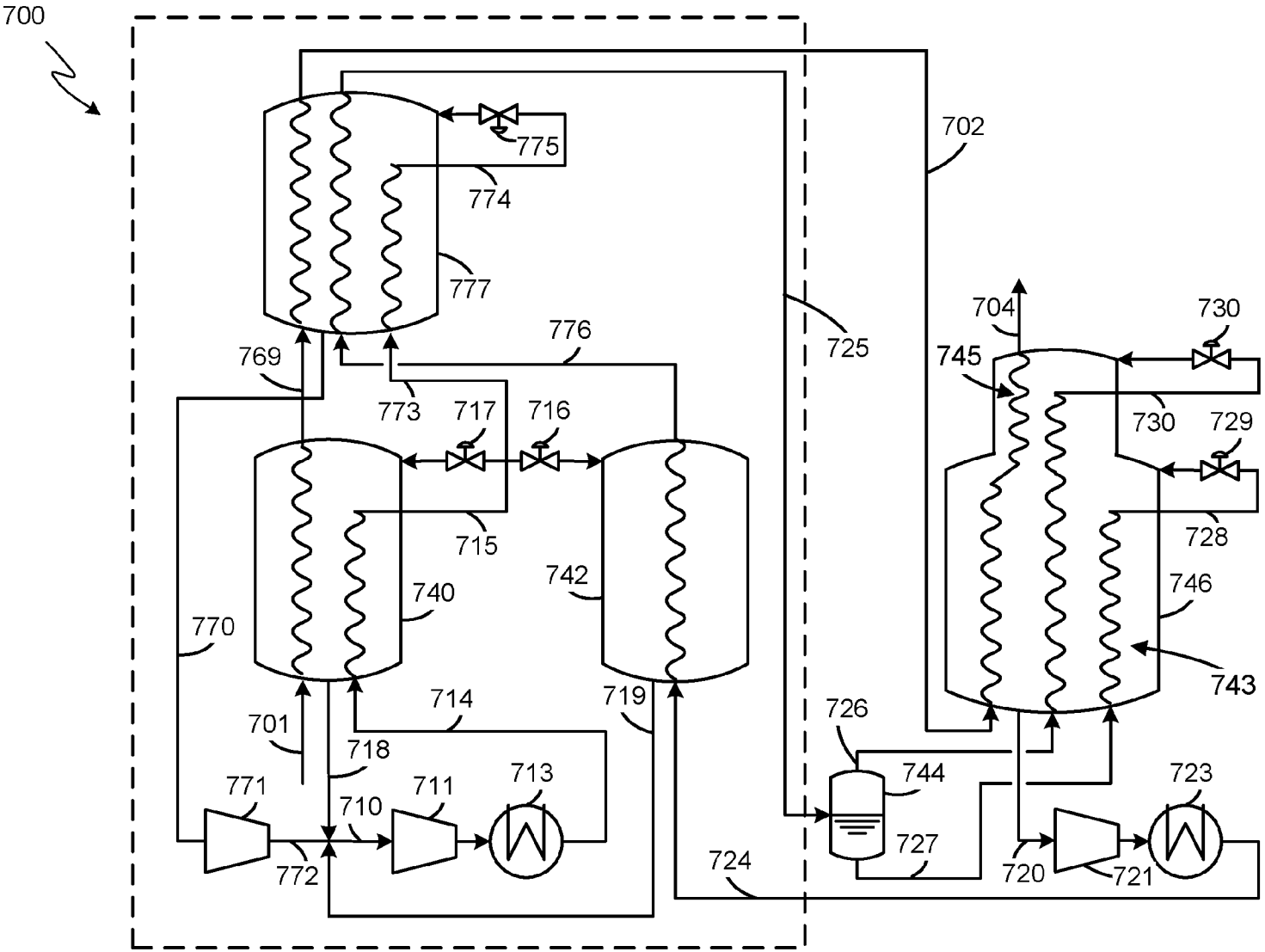
FIG. 7 is a schematic flow diagram of a gas liquefaction method and system in accordance with a sixth exemplary embodiment of the invention.

FIG. 7 shows a system 700 having a dual-pressure WMR configuration. In this embodiment, the natural gas feed stream 701 is cooled to an intermediate pre-cooling temperature in the first pre-cooler heat exchanger 740. The resulting stream 769 is further cooled to the final pre-cooling temperature in a third (cold) pre-cooler heat exchanger 777. The CMR stream 776, exiting the second pre-cooling heat exchanger 742 at an intermediate pre-cooling temperature, is cooled to the final pre-cooling temperature in the third pre-cooler heat exchanger 777. A portion of the WMR stream 715 is split into a separate stream 773, also at an intermediate pre-cooling temperature and is further cooled in the third pre-cooler heat exchanger 777 to the final pre-cooling temperature. The resulting stream 774 is throttled though a valve 775 to a pressure lower than the outlet pressure of the valves leading to the first and second pre-cooling heat exchangers 717 and 716 to provide refrigeration for the third pre-cooler heat exchanger. The resulting vapor stream 770, at below-ambient temperature, is compressed in the low-pressure WMR compressor 771. The resulting stream 772 may be cooled to about-ambient temperature. Typically, it is simply combined with the expanded MR streams 718 and 719 from the first and second pre-cooler heat exchangers to form a combined stream 710. Thus, the suction pressure of the WMR compressor 711 and the shell-side pressures of the first and second pre-cooler heat exchangers 740 and 742 is higher than the suction pressure of low pressure WMR compressor 771 and the shell-side pressure of the third pre-cooler heat exchanger 777.

This configuration may increase production in a retrofit. The heat exchangers can be placed side by side in a shipboard (floating) application.

Figure 8:
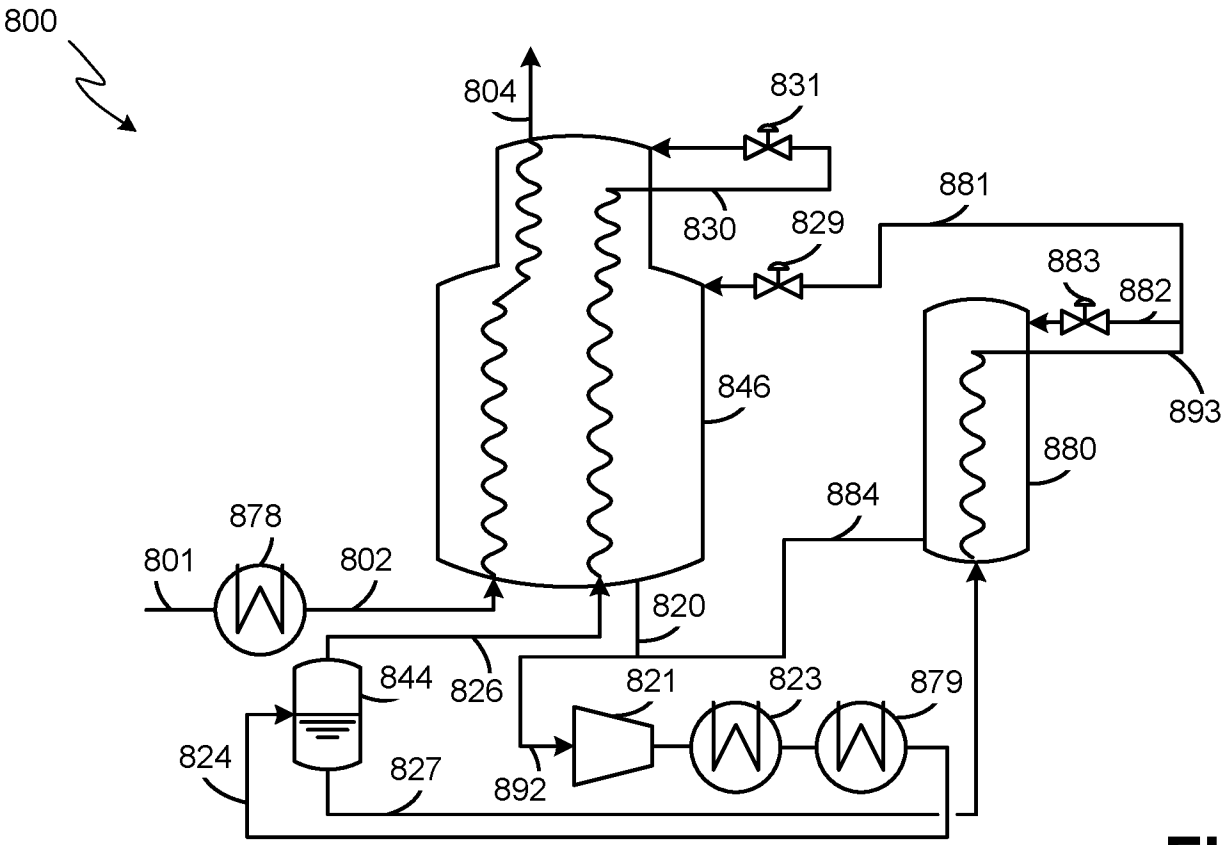
FIG. 8 is a schematic flow diagram of a gas liquefaction method and system in accordance with a seventh exemplary embodiment of the invention.

FIG. 8 shows a system 800 having a MCHE 846 similar to the one shown in FIGS. 2 through 7. The precooling systems 878 and 879 may be pre-cooler heat exchangers similar to those shown on the previous figures. They may use mixed refrigerant or pure refrigerant evaporating in a series of heat exchangers such as propane-precooled MR (C3MR), or may use another means of cooling such as lithium bromide absorption refrigeration. The precooling systems may share refrigerant and/or equipment.

An important feature of this embodiment is the use of an auxiliary heat exchanger 880 to cool the CMR liquid stream 827. The auxiliary heat exchanger 880 operates in parallel with the warm bundle of the MCHE 846. The cooled CMR liquid stream 893 is split into two streams 881 and 882 and throttled through valves 829 and 883 to provide refrigeration in both exchangers 846 and 880. The evaporated low-pressure MR stream 884 from the shell side of the auxiliary heat exchanger 880, is combined with the evaporated low-pressure MR stream 820 from the shell side of the MCHE 846, forming the input stream 892 to the CMR compressor 821 and closing the refrigeration cycle.

This embodiment can provide greater production and can operate more efficiently at the same production level than placing the MRL circuit in the MCHE 846.

It will be apparent to one skilled in the art that, alternatively, the CMR liquid stream 827 from the high-pressure phase separator 844 could be distributed between the MCHE 846 and the auxiliary heat exchanger 880. In this configuration the MCHE 846 contains both the CMR liquid stream 827 and the CMR vapor stream 826. This configuration is suitable for a retrofit to increase production because the auxiliary heat exchanger 880 and related conduits and equipment can be added to an existing system without significant modification to the MCHE 846.

Figure 9:
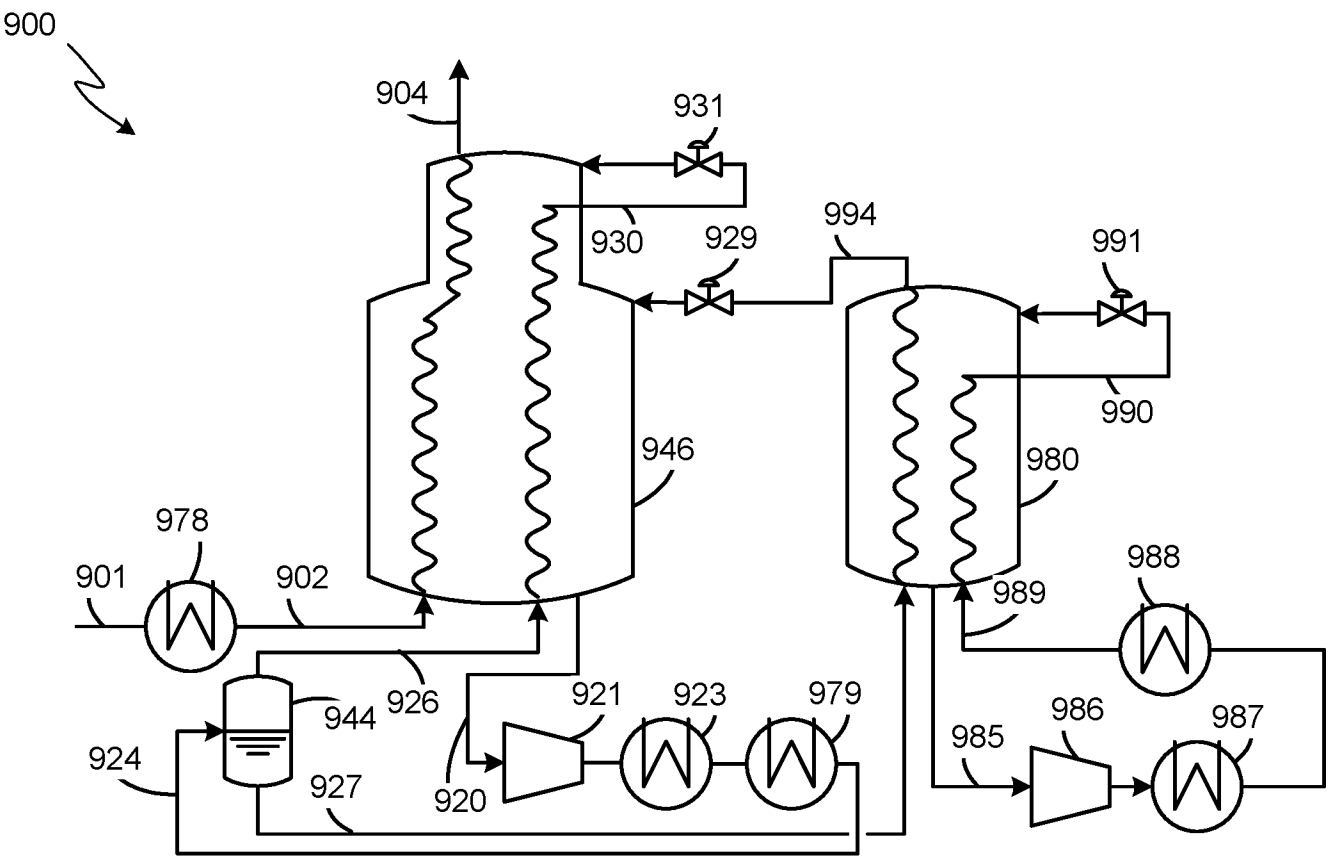
FIG. 9 is a schematic flow diagram of a gas liquefaction method and system in accordance with an eighth exemplary embodiment of the invention.

FIG. 9 shows a system 900 similar to the one in FIG. 8, but with a separate refrigerant loop. The evaporated low-pressure MR stream 985 from the shell side of the auxiliary heat exchanger 980 is compressed in an auxiliary compressor 986, cooled in an auxiliary aftercooler 987, and further cooled in an auxiliary precooling system 988. The resulting MR stream 989 is preferably fully condensed. It is further cooled in the auxiliary heat exchanger 980, and the resulting stream 990 is throttled through a valve 991 into the auxiliary heat exchanger 980 to provide refrigeration for the CMR liquid stream 927 from the high pressure phase separator 944.

Similar to the configuration shown in FIG. 8, the CMR liquid stream 927 from the high pressure phase separator 944 can be split and cooled both in the MCHE 946 and the auxiliary heat exchanger 980. This configuration is also well-suited for use as a retrofit of an existing plant.

Figure 11:
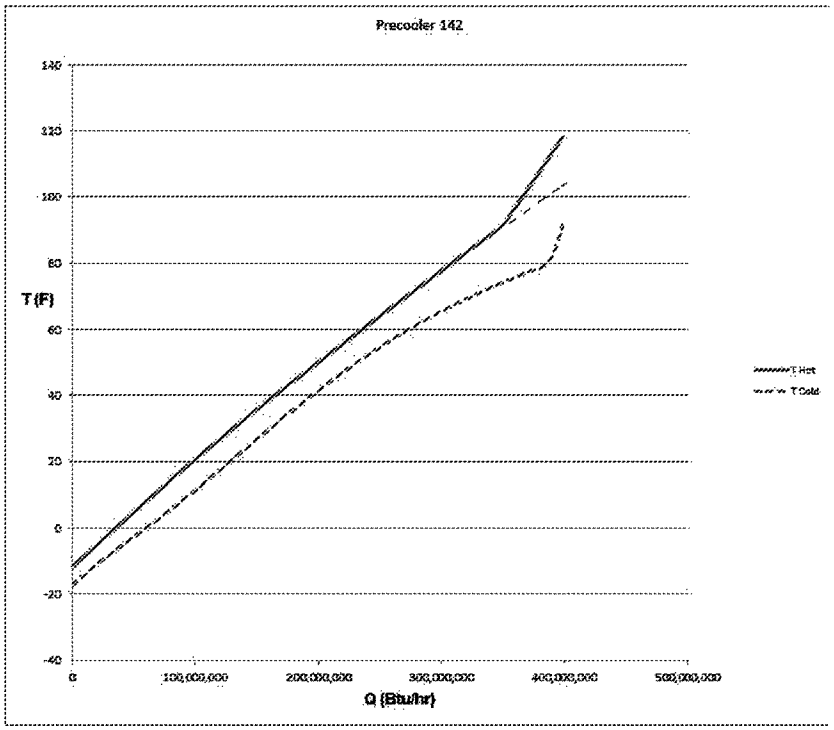
FIG. 11 is a graph showing cooling curves for refrigerants according to the embodiment of FIG. 2.
Figure 10:
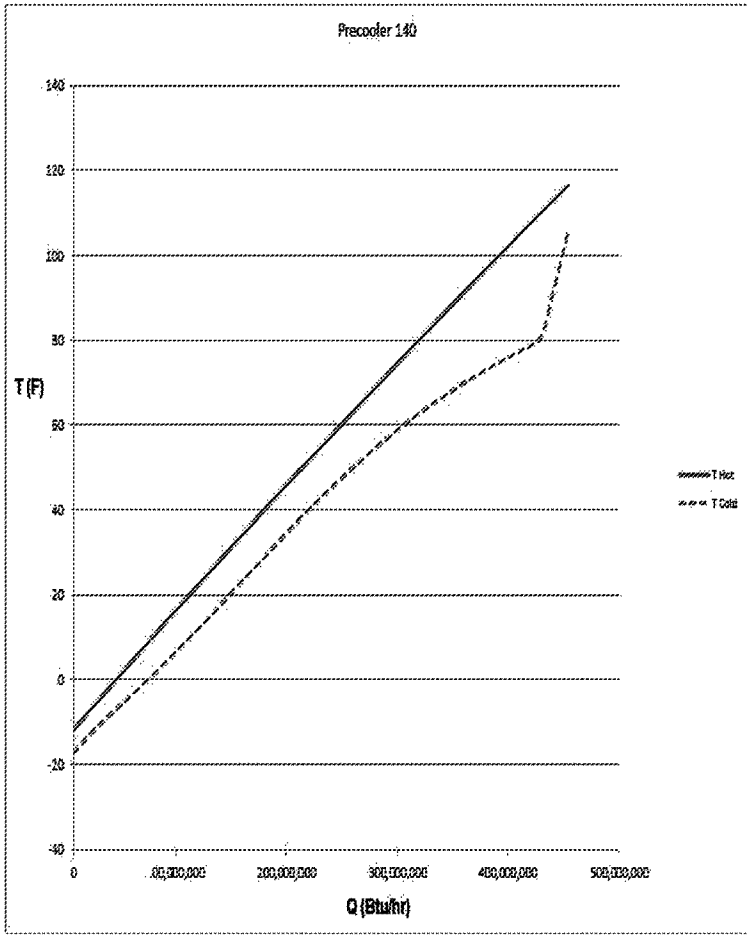
FIG. 10 is a graph showing cooling curves for refrigerants according to the embodiment of FIG. 2.

FIG. 10 shows cooling curves (duty vs. temperature of hot and cold streams) for the exchanger 240 shown in FIG. 2. Since both the feed and WMR do not undergo a phase change, the hot stream curve (solid) is almost a straight line. FIG. 11 shows cooling curves for the exchanger 242 shown in FIG. 2. Since the CMR undergoes a phase change, the hot stream curve (solid) is curved. This indicates that one can benefit from a different pre-cooler heat exchanger geometry for the second pre-cooler heat exchanger than the geometry of pre-cooler 240.

EXAMPLES

Example 1

Referring to FIG. 2, 18,450 lbmole/hr (8,369 kmol/hr) of natural gas 201 comprising 3.4% of nitrogen, 90% methane, 5% ethane, 1.5% propane, balance heavier hydrocarbons, at a pressure of 1,030 psia (7,102 kPa) and temperature of 118 deg. F. (321 K) is being liquefied. It is first cooled in the first pre-cooler heat exchanger 240 to −8 deg. F. (251 K). It is then cooled and liquefied in the main cryogenic heat exchanger (MCHE) 246. The stream 204 leaving the MCHE is at −241.4 deg. F. (121.3 K).

93,390 lb mole/hr (42,361 kmol/hr) of pre-cooling (warm) MR (WMR) 210 comprising 1.5% of methane, 52% ethane, 2.6% propane, balance n-butane and isobutene, is compressed in the WMR compressor 211 to 565 psia (3,900 kPa) and cooled in the cooler heat exchanger 213 to 118 deg. F. (321 K). The resulting near-saturated liquid stream 214 is further cooled in the first pre-cooler heat exchanger 240 to −8 deg. F. (251 K). The resulting stream 215 is then split into two streams. The first stream comprising 52% of the total flow, is throttled through a valve 217 to a pressure of 98 psia (676 kPa) and introduced to the shell side of the first pre-cooler heat exchanger 240 to provide cooling duty. The second stream, comprising 48% of the total flow, is throttled through a valve 216 to about the same pressure and introduced to the shell side of the second pre-cooler heat exchanger 242, for the same purpose. The two streams are warmed in the two pre-cooler heat exchangers to approximately the inlet temperature of 118 deg. F. (321 K). The fully evaporated WMR stream 218 from the first pre-cooler heat exchanger 240 and the fully evaporated WMR stream 219 from the second pre-cooler heat exchanger 242 are recombined 210 and introduced to the suction of the WMR compressor 211.

100,990 lb mole/hr (45,808 kmol/hr) of cold MR (CMR) 220 comprising 5.4% of nitrogen, 42% methane, 37% ethane, 11% propane, balance n-butane and isobutene, is compressed in the CMR compressor 221 to 890 psia (6,136 kPa) and cooled in the CMR aftercooler 223 to 118 deg. F. (321 K). The resulting vapor stream 224 is further cooled in the second pre-cooler heat exchanger 242 to −8 deg. F. (251 K). The resulting stream 225 is now 28% vapor (MRV) and 72% liquid (MRL) and is delivered to the high pressure phase separator 244. The MRL stream 227 is further cooled in the MCHE 246 to −193 deg. F. (148 K) and reduced in pressure in a dense fluid expander (hydraulic turbine) (not shown) followed by a valve 229 to a pressure of about 52 psia (360 kPa), and introduced to the shell side of the MCHE 246. The MRV stream 226 is further cooled in the MCHE 246 to −241.4 deg. F. (121.3 K). The resulting stream 230 is throttled through a valve 231 to about the same pressure as the MRL, and also introduced to the shell side of the MCHE 246. They both provide refrigeration for the MCHE 246. They are warmed up to approximately the inlet temperature of −8 deg. F. (251 K) and introduced 220 to the suction of the CMR compressor 221.

Example 2

Referring to FIG. 6, 124,291 lb mole/hr (56,377 kmol/hr) of natural gas comprising 0.2% of nitrogen, 97.8% methane, 1.3% ethane, 0.5% propane, 0.2% n-butane and isobutene, and balance heavier hydrocarbons, at a pressure of 1,320 psia (9,101 kPa) and temperature of 75.2 deg. F. (297 K) is being liquefied. It is split into two streams 665 and 667. The first feed stream 665, 48.4% of the total flow, is cooled in the first pre-cooler heat exchanger 640 to −70.1 deg. F. (216 K). The second feed stream 667, 51.6% of the total flow, is cooled in the second pre-cooler heat exchanger 642 to the same temperature of −70.1 deg. F. (216 K). The resulting two precooled feed streams 666 and 668 are combined 602 and then cooled and liquefied in the main cryogenic heat exchanger 646 (MCHE), leaving the MCHE at −245.8 deg. F. (119 K).

135,035 lb mole/hr (61,251 kmol/hr) of precooling warm MR (WMR) comprising 2.5% of methane, 60.3% ethane, 1.6% propane, balance n-butane and isobutene 610, is compressed in the WMR compressor 611 to 388 psia (2,675 kPa) and cooled in the cooler heat exchanger 613 to 75.2 deg. F. (297 K). The resulting near-saturated liquid 614 is further cooled in the first pre-cooler heat exchanger 640 to −70.1 deg. F. (216 K). It is then split into two streams. The first stream, about 50% of the total flow, is throttled through a valve 617 to a pressure of 45 psia (310 kPa) and introduced to the shell side of the first pre-cooler heat exchanger 640 to provide cooling duty. The second stream is throttled through a valve 616 to about the same pressure and introduced to the shell side of the second pre-cooler heat exchanger 642 for the same purpose. The two streams are warmed in the two pre-cooler heat exchangers to approximately the inlet temperature of 75.2 deg. F. (297 K). The fully evaporated WMR stream 618 from the first pre-cooler heat exchanger 640 and the fully evaporated WMR stream 619 from the second pre-cooler heat exchanger 642 are recombined 610 and introduced to the suction of the WMR compressor 611. If the warm-end temperature approaches on both pre-coolers 640 and 642 are the same the WMR split between the two pre-coolers is exactly 50%-50%. The duties of the two pre-cooler heat exchangers are about equal.

124,760 lb mole/hr (56,590 kmol/hr) of cold MR (CMR) comprising 10.84% of nitrogen, 50.55% methane, 33.73% ethane, 4.84% propane, balance n-butane and isobutene 620, is compressed in the CMR compressor 621 to 839 psia (5,785 kPa) and cooled in a cooler heat exchanger 623 to 75.2 deg. F. (297 K). The resulting vapor 624 is further cooled in the second pre-cooler heat exchanger 642 to −70.1 deg. F. (216 K). It is now 27% vapor (CMRV) and 73% liquid (CMRL). The CMRL stream 627 is further cooled in the warm bundle of the MCHE 643 to −207 deg. F. (140 K) and reduced in pressure in a dense fluid expander (hydraulic turbine, not shown) followed by a valve 629 to a pressure of about 72 psia (496 kPa), and introduced to the shell side of the MCHE 646. The CMRV stream 626 is further cooled in the cold bundle of the MCHE 645 to −245.8 deg. F. (119 K), throttled through a valve 631 to about the same pressure as CMRL, and also introduced to the shell side of the MCHE 646. Both the CMRV stream 630 and the CMRL stream 628 provide refrigeration for the MCHE 646. They are warmed up to approximately the inlet temperature of 75.2 deg. F. (297 K) and introduced to the suction of the CMR compressor 621.

What is claimed is:

1. A method for liquefying a hydrocarbon feed stream, the method comprising:

(a) providing a hydrocarbon fluid feed stream at a first feed temperature;

(b) splitting the hydrocarbon fluid feed stream into a first portion and a second portion;

(c) cooling the first portion of the hydrocarbon fluid feed stream in a first pre-cooling heat exchanger against a first mixed refrigerant to form a first pre-cooled hydrocarbon fluid stream that exits the first pre-cooling heat exchanger at a first pre-cooled temperature;

(d) cooling the second portion of the hydrocarbon fluid feed stream in a second pre-cooling heat exchanger against the first mixed refrigerant to form a second pre-cooled hydrocarbon fluid stream that exits the second pre-cooling heat exchanger at a second pre-cooled temperature, the second pre-cooling heat exchanger having a different geometry from the first pre-cooling heat exchanger;

(e) withdrawing an evaporated second mixed refrigerant stream from a shell side of a main heat exchanger;

(f) compressing and cooling the evaporated second mixed refrigerant stream to form a resultant second mixed refrigerant stream at a resultant second mixed refrigerant temperature, the resultant second mixed refrigerant temperature being substantially equal to the first feed temperature;

(g) cooling the resultant second mixed refrigerant stream in the second pre-cooling heat exchanger against the first mixed refrigerant to form a pre-cooled second mixed refrigerant stream that exits the second pre-cooling heat exchanger at a third pre-cooled temperature;

(h) combining the first pre-cooled hydrocarbon fluid stream and the second pre-cooled hydrocarbon fluid stream and introducing the combined pre-cooled hydrocarbon fluid stream into the tube side of the main heat exchanger;

(i) introducing at least a portion of the pre-cooled second mixed refrigerant stream into the tube side of the main heat exchanger;

(j) cooling the combined pre-cooled hydrocarbon fluid stream in the main heat exchanger against the second mixed refrigerant on the shell side of the main heat exchanger to form a liquefied hydrocarbon fluid stream;

(k) cooling the at least a portion of the pre-cooled second mixed refrigerant stream in the main heat exchanger against a flow the second mixed refrigerant on the shell side of the main heat exchanger to form at least one cooled second mixed refrigerant stream; and (l) withdrawing each of the at least one cooled second mixed refrigerant stream from the tube side of the main heat exchanger, expanding each of the each of the at least one cooled second mixed refrigerant stream to form an expanded second refrigerant stream, and providing each of the at least one expanded second mixed refrigerant stream to the shell side of the main heat exchanger.

2. The method of claim 1, further comprising:

(m) separating a liquid portion of the pre-cooled second mixed refrigerant stream from a vapor portion of the pre-cooled second refrigerant mixed stream;

wherein step (i) comprises introducing the liquid portion of pre-cooled second mixed refrigerant stream and the vapor portion of the pre-cooled second mixed refrigerant stream into the tube side of the main heat exchanger.

3. The method of claim 1, wherein the second pre-cooled temperature and third pre-cooled temperature are substantially equal to the first pre-cooled temperature.

4. The method of claim 1, wherein step (f) comprises compressing and cooling the second mixed refrigerant stream to form a resultant second mixed refrigerant stream at a resultant second mixed refrigerant temperature, the resultant second mixed refrigerant temperature being substantially equal to the first feed temperature and substantially all of the resultant second mixed refrigerant stream is vapor phase.

5. The method of claim 1, wherein step (c) comprises cooling the first portion of the hydrocarbon fluid feed stream in a tube side of a first pre-cooling heat exchanger against a first mixed refrigerant flowing through a shell side of the first pre-cooling heat exchanger to form a first pre-cooled hydrocarbon fluid stream that exits the first pre-cooling heat exchanger at a first pre-cooled temperature.

6. The method of claim 5, wherein step (d) comprises cooling the second portion of the hydrocarbon fluid feed stream in a tube side of a second pre-cooling heat exchanger against the first mixed refrigerant flowing through a shell side of the second pre-cooling heat exchanger to form a second pre-cooled hydrocarbon fluid stream that exits the second pre-cooling heat exchanger at a second pre-cooled temperature.

7. The method of claim 1, further comprising:

(n) circulating the first mixed refrigerant in a closed refrigeration loop that flows through a shell side of each of the first and second pre-cooling heat exchangers.

8. The method of claim 1, further comprising:

(o) withdrawing an evaporated first mixed refrigerant stream from a shell side of each of the first and second pre-cooling heat exchangers;

(p) compressing and cooling the evaporated first mixed refrigerant stream to form a resultant first mixed refrigerant stream;

(q) introducing the resultant first mixed refrigerant stream into a tube side of the first pre-cooling heat exchanger;

(r) cooling the resultant first mixed refrigerant stream in the first pre-cooling heat exchanger against a flow of the first mixed refrigerant on the shell side of the first pre-cooling heat exchanger to form a cooled first mixed refrigerant stream;

(s) withdrawing the cooled first mixed refrigerant stream from the first pre-cooling heat exchanger and splitting the cooled first mixed refrigerant stream into first and second cooled first mixed refrigerant streams;

(t) expanding each of the first and second cooled first mixed refrigerant streams to form first and second expanded first mixed refrigerant streams; and (u) introducing the first expanded first mixed refrigerant stream into the shell side of the first pre-cooling heat exchanger; and (v) introducing the second expanded first mixed refrigerant stream into a shell side of the second pre-cooling heat exchanger.

9. The method of claim 1, wherein step (d) comprises:

(d) cooling the second portion of the hydrocarbon fluid feed stream in a second pre-cooling heat exchanger against the first mixed refrigerant to form a second pre-cooled hydrocarbon fluid stream that exits the second pre-cooling heat exchanger at a second pre-cooled temperature, the second pre-cooling heat exchanger having the same refrigeration duty as the first pre-cooling heat exchanger.

* * * * *